US006758354B2

(12) United States Patent
Carletti

(10) Patent No.: US 6,758,354 B2
(45) Date of Patent: Jul. 6, 2004

(54) COLLAPSIBLE FRAMEWORK, SUCH AS A DISPLAY STAND, AND AN ARTICULATION JOINT FOR SUCH FRAMEWORK

(75) Inventor: Ottavio Carletti, Borgosesia (IT)

(73) Assignee: SMART s.n.c. di Carletti Ottavio & C., Gricnasco (IT)

( * ) Notice: Subject to any disclaimer, the term of this patent is extended or adjusted under 35 U.S.C. 154(b) by 0 days.

(21) Appl. No.: 10/069,391

(22) PCT Filed: Jun. 21, 2001

(86) PCT No.: PCT/EP01/07044

§ 371 (c)(1),
(2), (4) Date: May 16, 2002

(87) PCT Pub. No.: WO02/01540

PCT Pub. Date: Jan. 3, 2002

(65) Prior Publication Data

US 2002/0153339 A1 Oct. 24, 2002

(51) Int. Cl.[7] ..... A47F 5/00

(52) U.S. Cl. ..... 211/189; 211/182; 40/610; 52/646; 403/217

(58) Field of Search ..... 211/189, 182; 40/610; 52/109, 646; 403/169, 170, 171, 217

(56) References Cited

U.S. PATENT DOCUMENTS

| | | | | |
|---|---|---|---|---|
| 4,888,895 A | | 12/1989 | Kemeny | |
| 5,123,550 A | | 6/1992 | Nødskov et al. | |
| 6,530,712 B2 | * | 3/2003 | Boer | 403/217 |
| 6,553,698 B1 | * | 4/2003 | Kemeny | 40/610 |
| 2002/0059770 A1 | * | 5/2002 | Fvitsche et al. | 52/646 |

FOREIGN PATENT DOCUMENTS

| | | |
|---|---|---|
| EP | 0 419 006 A1 | 3/1991 |
| EP | 0 219 201 A2 | 4/1997 |
| FR | G 87 04 312.2 U1 | 8/1997 |
| WO | WO 99/06985 A1 | 2/1999 |
| WO | WO 99/49442 A1 | 2/1999 |

* cited by examiner

*Primary Examiner*—Robert W. Gibson, Jr.
(74) *Attorney, Agent, or Firm*—Sughrue Mion, PLLC

(57) ABSTRACT

A collapsible three dimensional framework includes a plurality of tubular rods (10) connected to each other by means of articulation joints. Each of the joints consists of a block divided into two matching pieces (28, 30). The block has a plurality of cavities (**18*a*, 18*b*) each of which is open on a respective side face and on a back face of the block. The ends of respective rods (10) are inserted in the cavities (18*a*, 18*b*) and are connected to the block by transverse pivot pins (24). Each of the cavities has articulation seats (32) which received the pivot pins (24) When the two pieces (28, 30) of the block are secured to each other, the pivot pins (24) are entrapped in respective seats (32). The two pieces (28, 30) of the block are clamped together by releasable fastening means such as a screw (40) and a nut (42**).

20 Claims, 5 Drawing Sheets

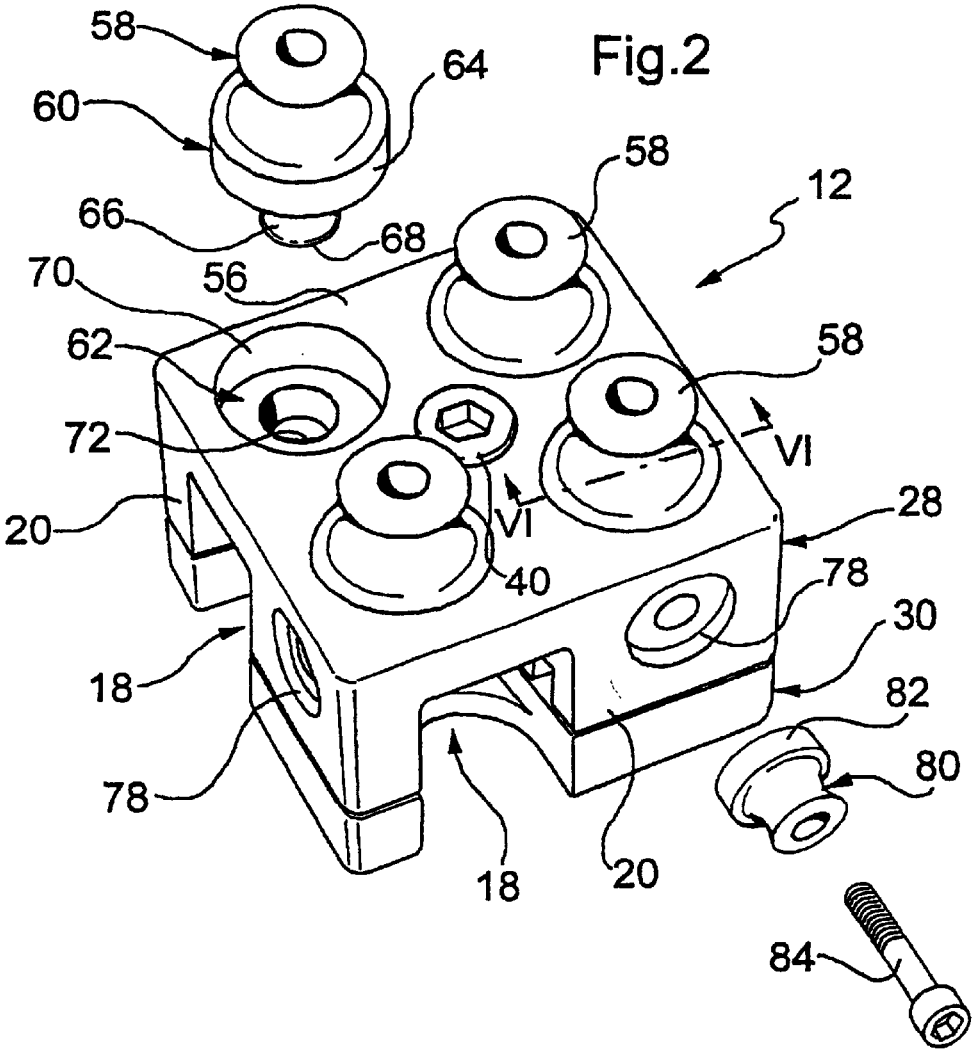
Fig.2
Fig. 7
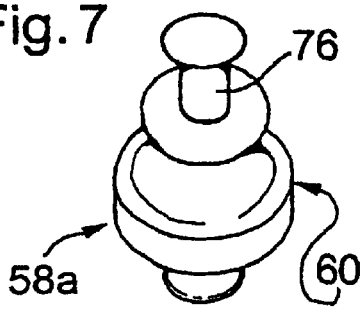
Fig. 6
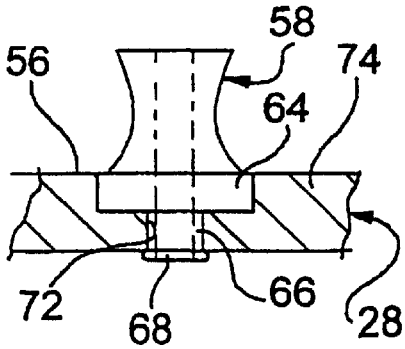

COLLAPSIBLE FRAMEWORK, SUCH AS A DISPLAY STAND, AND AN ARTICULATION JOINT FOR SUCH FRAMEWORK

This is a National stage entry under 35 U.S.C. §371 of PCT Application No. PCT/EP01/07044 filed Jun. 21, 2001; the disclosure of which is incorporated herein by reference.

BACKGROUND OF THE INVENTION

The present invention relates to a collapsible framework, such as a display stand, according to the preamble of claim 1.

Collapsible frameworks according to the preamble of claim 1 are known from documents EP-A-0 219 201, DE-U-87 04 312 and WO 89/09006.

In these known frameworks the blocks constituting the joints are in a single piece, the opposite sidewalls of their cavities which receive the ends of the rods have holes and the ends of the rods have holes as well. The rods are articulated to the blocks by pivot pins inserted in the holes.

One of the advantages of the frameworks of this kind, in addition to being collapsible, is that they allow to assemble frameworks of different shapes and dimensions from tubular rods of the same type and the same length and to connect these rods by means of joints of the same type.

The connection of the rods to the joints by means of pivot pins which, according to the known prior art, are inserted in the blocks and, transversally, in the ends of the rods, may be a relatively long and: difficult task because of which the time required to assemble a framework can turn out to be rather long.

SUMMARY OF THE INVENTION

The object of the invention is to provide a collapsible framework of the type set forth which can be assembled in times shorter than those required by the known frameworks, thanks to the fact that the articulated connections of the rods to the joints can be performed more easily.

According to the invention, this object is attained by means of a collapsible framework according to the characterizing portion of claim 1.

The assembly of a framework according to the invention is simpler and quicker than that of the known frameworks, because the operation by which each of the rods is pivotally coupled to a joint or block is easier.

In order to carry out this connection, while the two pieces of the block are taken apart, the ends of the rods are inserted into the corresponding cavities, whereupon the pivot pins which are fastened to the rods become engaged in the articulation seats. Once this engagement has been performed, it suffices to complete the block by securing its two pieces to each other, whereupon the pivot pins remain entrapped in the seats within the block.

The invention also relates to an articulation joint as claimed.

BRIEF DESCRIPTION OF THE DRAWINGS

The invention will become more clear from the reading of the detailed description which follows, reference being made to the appended drawings, given by way of non-limiting example, and in which:

FIG. 2 is a partially exploded, perspective view on a larger scale of a joint of the framework of FIG. 1.

FIG. 6 is a partial cross-section taken in the plane indicated VI—VI in FIG. 2, FIG. 7 is a perspective view of a profiled peg or button which may be used instead of the profiled pegs or buttons of FIG. 2.

Referring to FIG. 1, a three-dimensional collapsible framework has a plurality of tubular rods 10 which are connected with each other by means of articulation joints 12.

The framework further includes tubular spacer rods 14, associated with opposite joints 12.

Figure 1:
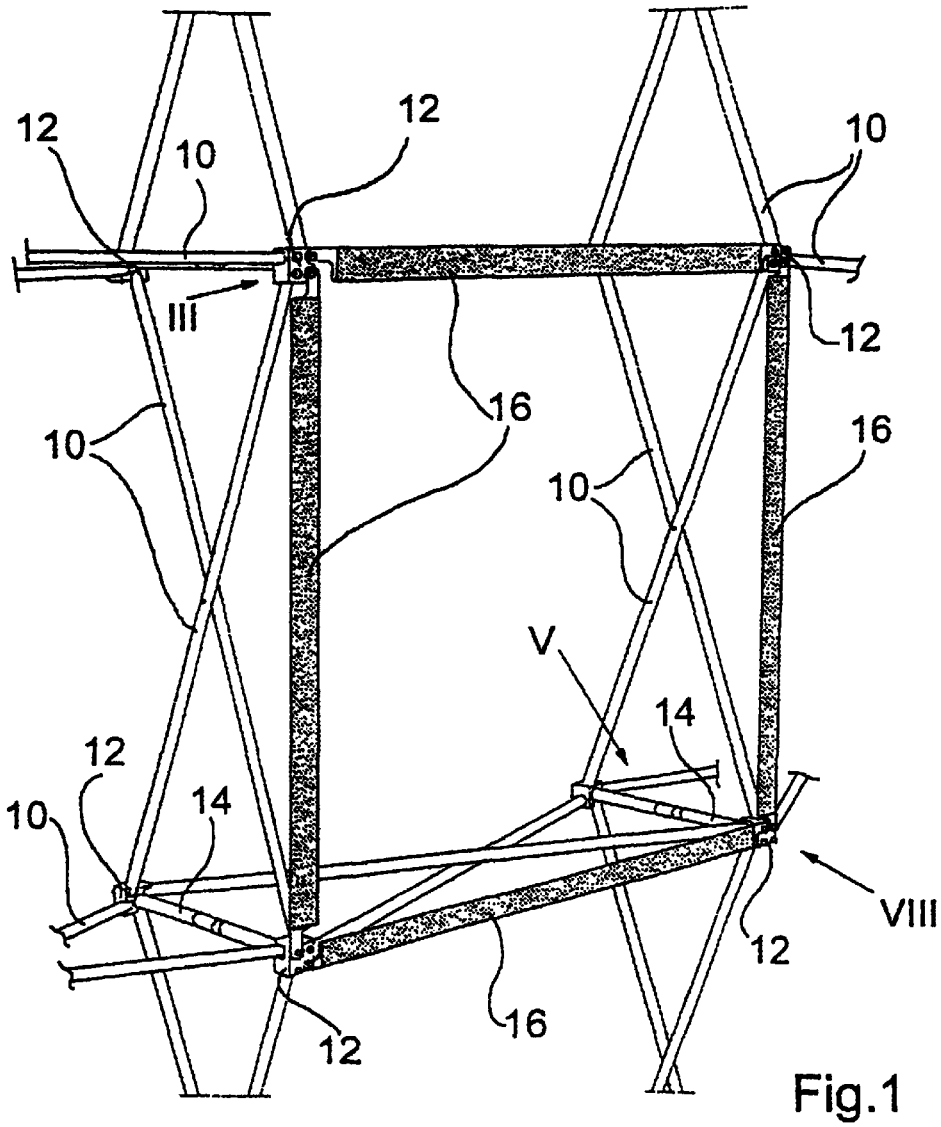
FIG. 1 is a perspective view of a portion of a collapsible framework according to the invention.

In FIG. 1 removable slats 16 are shown which are coupled to corresponding joints 12 in a manner which will be explained below.

The slats 16 constitute a frame for supporting a panel or the like and can contain a core of ferrous material so that a panel or the like can be affixed to the slats by means of magnets.

Figure 3:
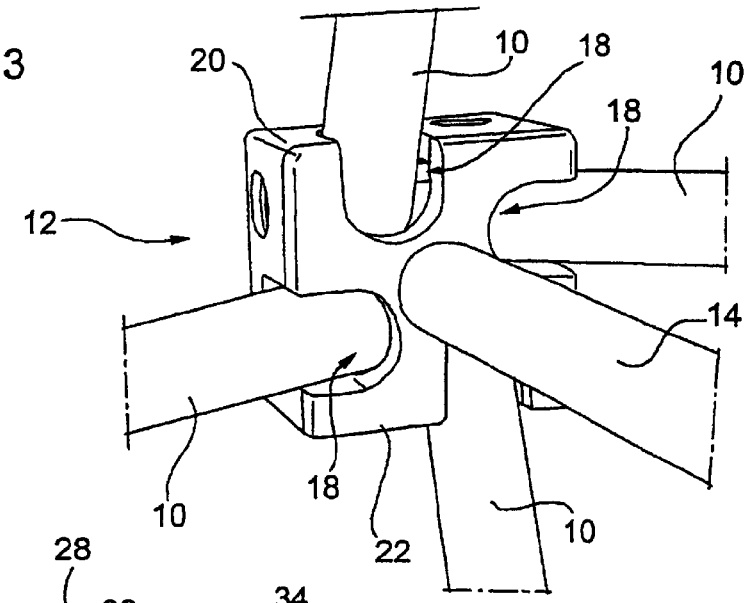
FIG. 3 is a perspective view on a larger scale of the region of a joint indicated III in FIG. 1.
Figure 4:
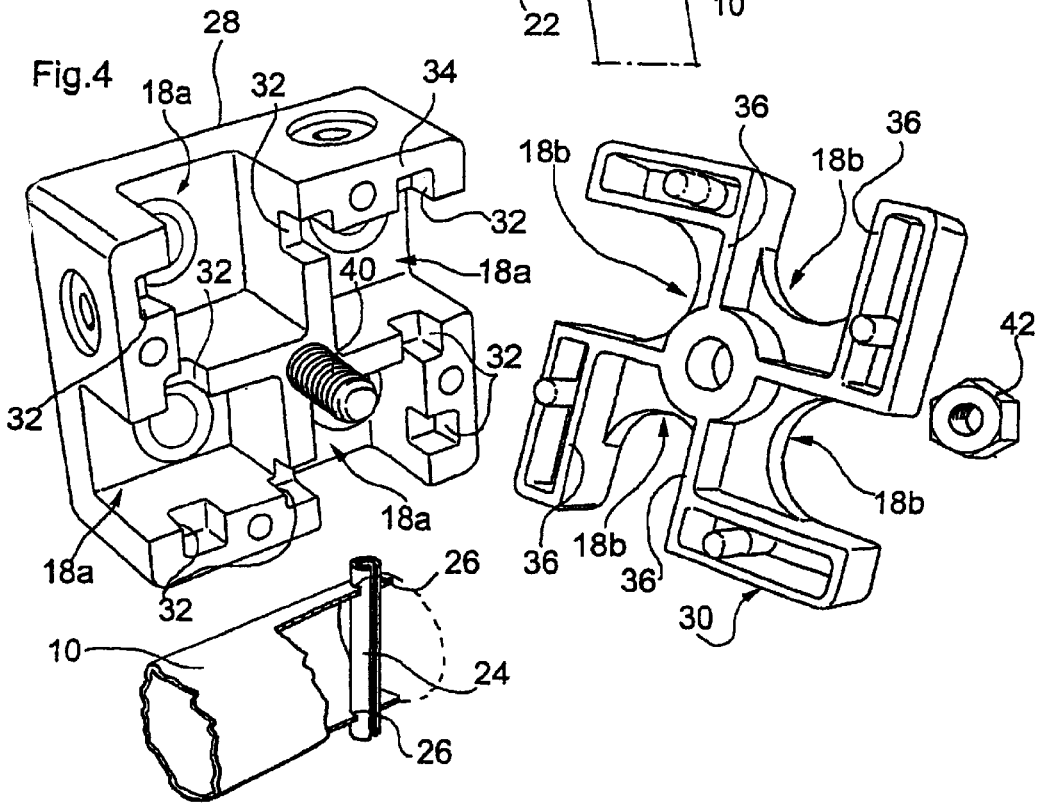
FIG. 4 is an exploded perspective view which shows the joint with its two pieces taken apart from each other, as well as an end of a rod.

Referring to FIGS. 2 to 4, each of the joints 12 consists of a block having a substantially parallelepipedal shape.

The block 12 has a plurality of cavities 18, four in number in the embodiment shown.

Each of the cavities 18 is open on a respective lateral face 20 and on a back face 22 of the block 12.

The ends of respective rods 10 are inserted in the cavities 18 (FIG. 3), and such ends are connected to the block 12 by transverse pivot pins one of which, indicated 24, is shown in FIG. 4.

The transverse pivot pins 24 are fastened to respective rods 10 and project from the rods in opposite positions.

Preferably, as shown, each transverse pivot pin 24 is constituted by a resilient tubular split dowel which is driven into diametrically opposite holes 26 of the respective rod 10.

The block 12 is divided into two pieces 28, 30 which match to each other according to a separation plane.

In a direction perpendicular to this separation plane the piece 28 has a relatively great thickness, while the other piece 30 has a relatively small thickness.

The cavities 18 are provided for the major part, as indicated at 18*a* in FIG. 4, in the piece 28 of greater thickness of the block 12 and are completed by portions of cavity (indicated 18*b* in FIG. 4) which are provided in the piece 30 of smaller thickness of the block 12.

Still referring to FIG. 4, articulation seats 32 for the pivot pins 24 of the rods 10 are formed in the piece 28 of the block 12.

The seats 32 are open to the corresponding cavities 18, or better to say to the cavity portions 18*a*, in laterally opposite positions.

As can be seen in FIG. 4, the articulation seats 32 are in the form of recesses which are open both to the corresponding cavity portions 18*a* and on a face of the block piece 28 which coincides with the separation plane between the two pieces 28, 30.

The other piece 30 of the block 12 has, in the matching plane with the piece 28, flat surfaces 36 which, when the two pieces 28, 30 are joined, close the openings of the recesses 32.

In order to pivotally connect a rod 10 to a block 12, while the two pieces 28, 30 are taken apart as in FIG. 4, it suffices to introduce the end of the rod 10 into the corresponding cavity portion 18*a* until the projecting ends of the pivot pin 24 are engaged in the recesses 32, after which the two pieces 26, 30 of the block 12 are joined to each other and the pivot pin 24 remains entrapped.

The two pieces 28, 30 of the block are then secured together by releasable fastening means. Preferably, as shown in FIGS. 2 and 4, these securing means are constituted by a tightening screw 40 which centrally extends in the two pieces 28, 30 of the block 12, perpendicularly to its separation plane.

A tightening nut 40 is associated with the screw 40.

Figure 5:
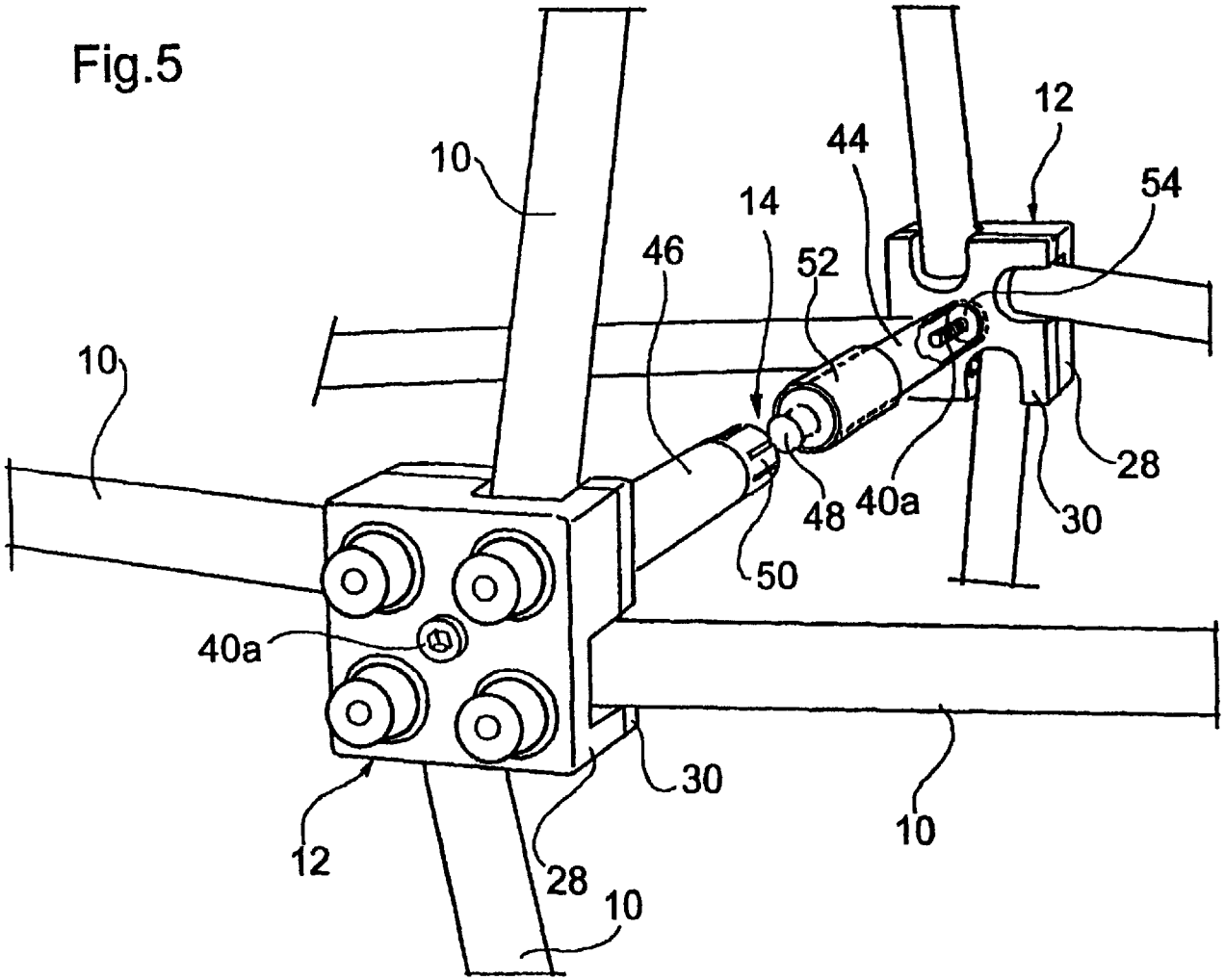
FIG. 5 is a perspective view on a larger scale of the region indicated V in FIG. 1.

Reference will now be made to FIG. 5 to describe one of the spacer tubular rods 14.

The function of the spacer rods 14 is to ensure that the three-dimensional framework remains in a stable configuration in the unfolded condition shown in FIG. 1.

Each of the spacer rods 14 is preferably in two sections 44, 46, each of which is fixed to a respective joint or block 12 in a manner which will be described below.

The two sections 44, 46 are provided with mutual coupling means. Preferably, the section 44 has, at the end thereof which is remote from the corresponding block 12, a mushroom-shaped appendage 48 of plastics material which fits into a tulip-shaped resilient clamp which is located at the end remote from the corresponding block 12.

The section 44 has a sleeve which is adapted to slide thereon and which, when the mushroom-shaped appendage has been fitted into the clamp 50, is brought by sliding to a position in which it surrounds the clamp both to prevent the clamp from expanding, and to impart an aesthetic aspect to the spacer rod 14.

Each of the sections 44, 46 is secured to the respective block 12 by the same central screws which keep the two pieces 28, 30 of the blocks 12 together.

These screws, indicated 40*a*, have a length which is larger than that of the screws 40 which keep the two pieces 28, 30 together when no spacer rod 14 is associated with the corresponding block 12.

An internally threaded bushing 54 is driven into the end of each of the sections 44, 46 which faces the corresponding block 12, the shank of the corresponding screw 40*a* being screwed within said bushing.

The bushing 54 can replace the nut 42 shown in FIG. 4, or be provided in addition to the nut 42.

Returning to FIG. 2, a front face 56 of the block 12, opposite to its back face 22, has pegs 58 which are substantially diabolo-shaped and constitute buttons to which accessories can be fixed. Preferably, as shown, the pegs 58 are constituted by pieces of plastics material which are distinct from the corresponding piece 28 of the block 12.

Each peg 58 has a foot portion 60 which is fitted into a corresponding seat 62 provided in the front face 56.

Preferably, as shown in FIGS. 2 and 6, each foot portion 60 includes a first cylindrical section 64 of larger diameter, from which there extends a second resilient tubular cylindrical section 66 of smaller diameter, which ends with an outer annular rim 68.

The corresponding seats 62 have in their turn a first cylindrical section 70 of larger diameter, to receive the said first section 64, and a second cylindrical section 72 of smaller diameter, to receive the said second section 66.

The second section 66 of the foot portion 60 extends through a wall 74 of the block piece 28. The arrangement is such that the rim 68, when the foot portion 60 is being pushed home, engages with a snap fit around the inner mouth of the second section 72 of the seat 62.

FIG. 7 shows a modification of the peg, indicated 58*a*, which can replace the pegs 58 of FIG. 2.

The foot portion, still indicated 60, of the peg 58*a* is identical to that of the pegs 58.

The peg 58*a* differs from the peg 58 in that a mushroom-shaped appendage 76 extends from its outer end, to be used for suspending articles of various kinds.

Returning to FIG. 2, also the side faces 20 of the block 12 have cylindrical seats 78 in the piece 28.

Other pegs 80 can be associated with the said seats 78 and have a cylindrical foot portion 82 which can be fitted into the seats 78.

As an example, the lateral pegs 80 can be fixed to the block piece 28 by means of screws such as 84.

Figure 8:
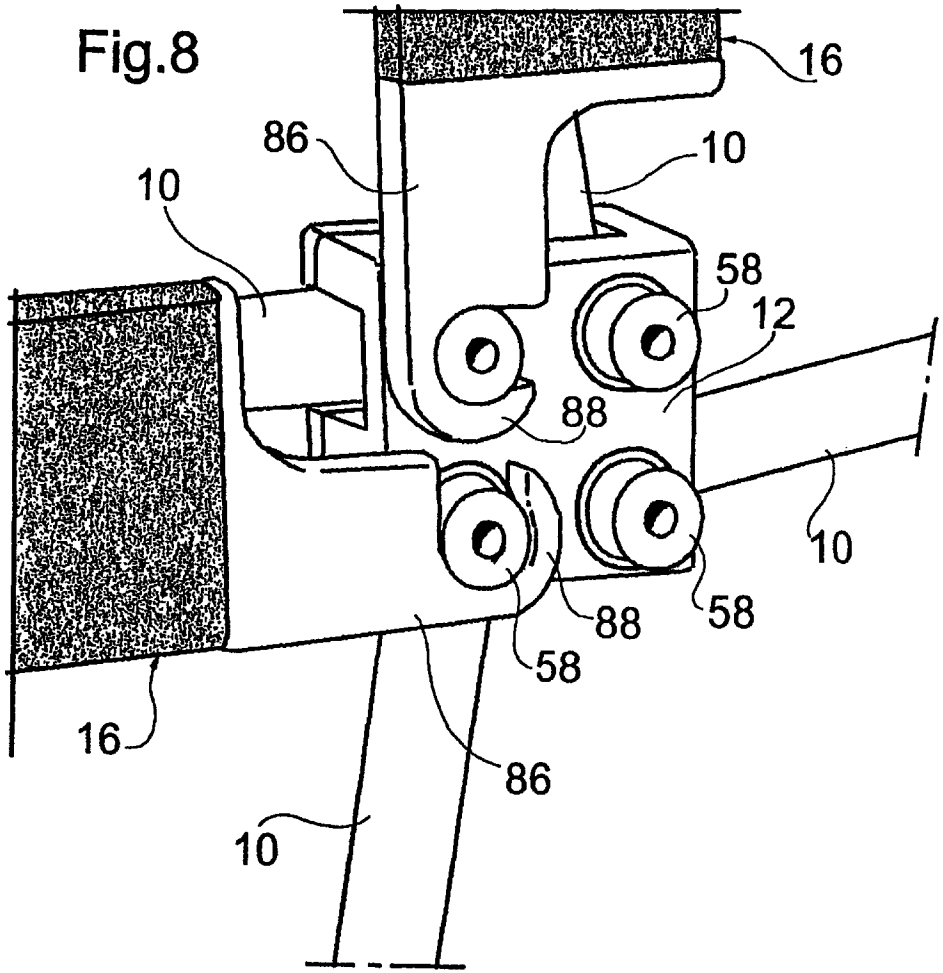
FIG. 8 is a perspective view on a larger scale of the region indicated VIII in FIG. 1.

Referring to FIG. 8, each slat 16 has, at its ends, end parts 86 provided with hook-shaped formations 88 which embrace the recessed portions of the pegs 58.

Preferably, the hook-shaped formations 88 are resilient and embrace the recessed portions of the pegs 58 over an arc of circumference which is slightly wider than 180°, so that the formations 88 hook themselves around the pegs 58 with a snap fit.

What is claimed is:

1. A collapsible three-dimensional framework, such as a display stand, including a plurality of tubular rods (10) connected to each other by means of articulation joints, each of which joints consists of a block (12) of a substantially parallelepipedal shape which has a plurality of cavities (18) each of which is open on a respective side face (20) and on a back face (22) of the block (12), and in which cavities there are inserted the ends of respective rods (10) which are connected to the block (12) by transverse pivot pins (24), fastened to the rods (10), extend from the rods in diametrically opposite positions and are engaged in respective articulation seats (32) formed in the block (12) and open to the corresponding cavities (18) in opposite lateral positions, in that the block (12) is subdivided into two piecess (28, 30) which match with each other according to a separation plane which is parallel to its back face (22) and located in correspondence with the articulation seats (32) each of which are located in only one of the two pieces, and in that two pieces (28, 30) of the block (12) are secured to each other by relaesable fastening means (40, 42) in such a manner as to allow the insertion of the pivot pins (24) with a movement substantially perpendicular to the separation plane when the two pieces (28, 30) of the block (12) are separate and to entrap the pivot pins (24) in the seats (32) when these two pieces are joined to each other.

2. A framework according to claim 1, characterized in that the transverse pivot pins (24) of the rods (10) are constituted by resilient tubular split dowels which are driven in diametrically opposite holes (26) of the rods.

3. A framework according to claim 1, characterized in that the said releasable fastening means are constituted by a clamping screw (40) which extends centrally in the two pieces (28, 30) of the block (12), perpendicularly to its separation plane, and to which a nut (42) is associated.

4. A framework according to claim 3, characterized in that at least two opposite blocks (12) have a spacer tubular rod (14) associated thereto, in that the screws (40*a*) of said blocks (12) extend in the corresponding ends of the spacer rod (14), and in that internally threaded bushings (54) are driven in said ends and are associated in the manner of nuts to said screws (40*a*).

5. A framework according to claim 4, characterized in that the spacer tubular rods (14) are in two sections (44, 46), each of which is secured to a respective block (12) and whose ends remote from the corresponding sections are provided with mutual coupling means (48, 50).

6. A framework according to claim 1, wherein the articulation seats are in the form of recesses which are open both to the corresponding cavities (18) and on a face (34) of the said piece of the block (12) which coincides with the separation plane, and in that the other piece (30) of the block (12) has, in the separation plane, flat surfaces (36) which close the outlets of the recesses (32) in the said plane to entrap the pivot pins (24) of rods (10).

7. A framework according to claim 6, characterized in that the piece of the block (12) which contains the recesses (32) which receive the pivot pins (24) is the piece (28) opposite to that which has the back face (22) and has, in the direction perpendicular to that of the separation plane, a relatively great thickness, while the other piece (30) of the block (12) has a relatively small thickness.

8. A framework according to claim 1, characterized in that the block (12) has, at least on its front face (56) remote from its back face (22) at least one profiled peg or button (58, 58*a*) to which accessories can be fixed.

9. A framework according to claim 8, characterized in that the block (12) has, at least on one of its side faces (20), at least one profiled peg or button (80) to which accessories can be affixed.

10. A framework according to claim 8, characterized in that the profiled pegs or buttons (58, 58*a*, 80) are constituted by pieces distinct from the corresponding piece (28) of the block (12) and which have foot portions (60, 82), and in that such piece (28) of the block (12) has corresponding seats (62, 78) into which the foot pieces can be fitted.

11. A framework according to claim 10, characterized in that the foot portions (60) include a first cylindrical section (64) of a greater diameter from which there extends a second resilient tubular cylindrical section (66) of a smaller diameter which ends with an annular outer rim (68), and in that the corresponding seats (62) have a first cylindrical section (70) of a greater diameter to receive the said first section (64) of the foot portion (60) and a second cylindrical (72) of a smaller diameter to receive the second section (66) of the foot portion (60), which second section (66) extends through a wall (74) of the block piece (28), the arrangement being such that said rim (68), when the foot portion (60) is pushed home, is snap engaged around the inner mouth of the second section (72).

12. A framework according to claim 8, characterized in that the pegs (58) have recessed portions, and the framework includes support slats (16) which have end pieces (86) provided with hook-shaped formations (88) which embrace with a snap fit the recessed potions of the pegs (58).

13. An articulation joint in the form of a block for a collapsible three-dimensional framework, such as a display stand, the framework including a plurality of tubular rods (10) connected to each other by means of articulation joints, wherein the joint consists of a block (12) of a substantially parallelepipedal shape which has a plurality of cavities (18) each of which is open on a respective side face (20) and on a back face (22) of the block (12), which cavities are adapted to the insertion of the ends of respective rods (10) of the framework which are adapted to be connected to the block (12) by transverse pivot pins (24) which extend from the rods in diametrically opposite positions, wherein the block (12) has articulation seats (32) formed therein and open to corresponding cavities (18) in opposite lateral positions to receive transverse pivot pins (24) which extend from the rods (10) in diametrically opposite positions, in that the block (12) is subdivided into two pieces (28, 30) which match with each other according to a separation plane which is parallel to its back face (22) and located in correspondence with the articulation seats (32) which are formed in only one of the two pieces of the block, and in that the two pieces (28, 30) of the block (12) are secured to each other by releasable fastening means (40, 42) in such a manner as to allow the insertion of the pivot pins (24) with a movement substantially perpendicular to the separation plane when the two pieces (28, 30) of the block (12) are separate and to entrap the pivot pins (24) in the seats (32) when these two pieces are joined to each other.

14. An articulation joint according to claim 13, characterized in that the said releasable fastening means are constituted by a clamping screw (40) which extends centrally in the two pieces (28, 30) of the block (12), perpendicularly to its separation plane, and to which a nut (42) is associated.

15. A framework according to claim 13, wherein the articulation seats are in the form of recesses which are open both to the corresponding cavities (18) and on a face (34) of the said piece of the block (12) which coincides with the separation plane, and in that the other piece (30) of the block (12) has, in the separation plane, flat surfaces (36) which close the outlets of the recesses (32) in the said plane to entrap the pivot pins (24) of rods (10).

16. An articulation joint according to claim 15, characterized in that the piece of the block (12) which contains the recesses (32) which receive the pivot pins (24) is the piece (28) opposite to that which has the back face (22) and has, in the direction perpendicular to that of the separation plane, a relatively great thickness, while the other piece (30) of the block (12) has a relatively small thickness.

17. An articulation joint according to claim 13, characterized in that the block (12) has, at least on its front face (56) remote from its back face (22), at least one profiled peg or button (58, 58*a*) to which accessories can be fixed.

18. An articulation joint according to claim 17, characterized in that the block (12) has, at least on one of its side faces (20), at least one profiled peg or button (80) to which accessories can be affixed.

19. An articulation joint according to claim 13, characterized in that the block (12) has, at least on its front face (56) remote from its back face (22), at least one profiled peg or button (58, 58*a*) to which accessories can be fitted.

20. An articulation joint according to claim 19, characterized in that the foot portions (60) include a first cylindrical section (64) of a greater diameter from which there extends a second resilient tubular cylindrical section (66) of a smaller diameter which ends with an annular outer rim (68), and in that the corresponding seats (62) have a first cylindrical section (70) of a greater diameter to receive the said first section (64) of the foot portion (60) and a second cylindrical (72) of a smaller diameter to receive the second section (66) of the foot portion (60), which second section (66) extends through a wall (74) of the block piece (28), the arrangement being such that said rim (68), when the foot portion (60) is pushed home, is snap engaged around the inner mouth of the second section (72).

* * * * *